US009149698B2

(12) United States Patent
Spiegler

(10) Patent No.: US 9,149,698 B2
(45) Date of Patent: Oct. 6, 2015

(54) BALL SKILL ENHANCEMENT TRAINING PROGRAMS AND METHODS

(75) Inventor: David J. Spiegler, Chicago, IL (US)

(73) Assignee: Virberu L.L.C., Chicago, IL (US)

( * ) Notice: Subject to any disclaimer, the term of this patent is extended or adjusted under 35 U.S.C. 154(b) by 159 days.

(21) Appl. No.: 13/540,147

(22) Filed: Jul. 2, 2012

(65) Prior Publication Data

US 2013/0150188 A1 Jun. 13, 2013

Related U.S. Application Data

(63) Continuation-in-part of application No. 29/397,777, filed on Jul. 20, 2011, and a continuation-in-part of application No. 29/397,778, filed on Jul. 20, 2011.

(51) Int. Cl.

| | |
|---|---|
| ***A63B 69/00*** | (2006.01) |
| ***A63B 37/12*** | (2006.01) |
| ***A63B 43/00*** | (2006.01) |

(52) U.S. Cl.

CPC ..... *A63B 69/0002* (2013.01); *A63B 37/12* (2013.01); *A63B 43/008* (2013.01); *A63B 2037/125* (2013.01); *A63B 2069/0006* (2013.01); *A63B 2069/0008* (2013.01)

(58) Field of Classification Search

CPC ..... A63B 69/0002; A63B 43/0008; A63B 43/00; A63B 2069/0006; A63B 2069/0002; A63B 37/12; A63B 37/00; A63B 2243/0004; A63B 2037/125; A63B 2037/12

USPC ..... 473/422, 450, 451, 458, 598, 609, 613; D21/713, 714

See application file for complete search history.

(56) References Cited

U.S. PATENT DOCUMENTS

| | | | | | |
|---|---|---|---|---|---|
| 280,807 | A | | 7/1883 | Farley | |
| 465,507 | A | * | 12/1891 | Windoes | 473/600 |
| 676,506 | A | * | 6/1901 | Knight et al. | 473/353 |
| 992,343 | A | | 5/1911 | Dils | |
| D50,652 | S | * | 4/1917 | Blamey, Jr. et al. | D21/714 |
| 1,634,146 | A | | 6/1927 | Belulah | |
| 2,776,139 | A | * | 1/1957 | Blamey, Jr. et al. | 473/613 |
| 2,925,273 | A | * | 2/1960 | Pratt | 473/451 |
| 3,228,686 | A | | 1/1966 | Faulkner, III | |
| 3,504,914 | A | | 4/1970 | Bradbury | |
| 3,976,295 | A | * | 8/1976 | Heald, Jr. | 473/598 |
| 4,170,352 | A | * | 10/1979 | Vcala | 473/459 |
| 4,235,441 | A | * | 11/1980 | Ciccarello | 473/267 |
| 4,256,304 | A | * | 3/1981 | Smith et al. | 473/451 |
| 4,261,565 | A | * | 4/1981 | Massino, Sr. | 473/598 |
| 4,345,759 | A | * | 8/1982 | Nims | 473/569 |
| D288,461 | S | * | 2/1987 | Hirai | D21/713 |
| D288,462 | S | * | 2/1987 | Hirai | D21/713 |
| 4,828,262 | A | | 5/1989 | Henley | |

(Continued)

*Primary Examiner* — Mitra Aryanpour

(74) *Attorney, Agent, or Firm* — Leydig, Voit & Mayer, Ltd

(57) ABSTRACT

A training program for improving hitting of a baseball enhancing a batter's tracking skills to a plurality of pitched baseballs. The training program provides a set of baseballs which includes a plurality of patterned baseballs and at least one conventional baseball. Each of the patterned baseballs includes a cover with a perceptible pattern provided thereon, such as a generally elliptical marking conforming to a seam disposed on the cover of the baseball as well as a generally circular marking disposed within the elliptical marking. An instructor or the like detects an audible response from the batter of the color of the pitched baseball as perceived by the batter when the baseball enters the batter's hitting zone.

16 Claims, 6 Drawing Sheets

(56) References Cited

U.S. PATENT DOCUMENTS

| | | | | | |
|---|---|---|---|---|---|
| 4,874,169 | A | * | 10/1989 | Litchfield | 473/613 |
| 4,915,384 | A | * | 4/1990 | Bear | 473/451 |
| 4,919,422 | A | * | 4/1990 | Ma | 473/613 |
| 4,991,838 | A | * | 2/1991 | Groves | 473/451 |
| 5,133,556 | A | | 7/1992 | Karasavas | |
| 5,145,473 | A | | 9/1992 | Henry | |
| 5,280,906 | A | * | 1/1994 | Vitale | 473/613 |
| 5,588,648 | A | * | 12/1996 | Stebbins | 473/451 |
| 5,603,497 | A | * | 2/1997 | Louez | 473/609 |
| 5,607,152 | A | * | 3/1997 | Strassburger | 473/451 |
| 5,711,725 | A | * | 1/1998 | Bengtson | 473/451 |
| 5,716,283 | A | | 2/1998 | Simpson et al. | |
| 5,820,495 | A | * | 10/1998 | Howland | 473/451 |
| D407,127 | S | | 3/1999 | Teifert | |
| 5,893,806 | A | * | 4/1999 | Martinez | 473/447 |
| 5,984,813 | A | * | 11/1999 | Cinnella | 473/613 |
| D434,816 | S | * | 12/2000 | Jobst | D21/713 |
| 6,261,197 | B1 | * | 7/2001 | Grechko | 473/598 |
| 6,447,408 | B1 | * | 9/2002 | Bonaventura | 473/422 |
| 6,612,942 | B1 | * | 9/2003 | Battersby et al. | 473/451 |
| D503,955 | S | | 4/2005 | Raymond | |
| 7,048,656 | B2 | * | 5/2006 | Litchfield | 473/598 |
| 7,059,862 | B2 | * | 6/2006 | McGinley | 434/247 |
| D525,325 | S | | 7/2006 | Hanna, Sr. | |
| D528,176 | S | | 9/2006 | Milliken | |
| D531,240 | S | | 10/2006 | Geisendorfer | |
| D546,911 | S | | 7/2007 | Kirschbaum et al. | |
| D571,419 | S | | 6/2008 | Katzke | |
| 7,563,183 | B2 | | 7/2009 | Kucek | |
| D599,963 | S | | 9/2009 | Crane et al. | |
| D600,757 | S | * | 9/2009 | Boyan | D21/714 |
| D602,553 | S | | 10/2009 | Wright | |
| 7,608,003 | B1 | * | 10/2009 | Fusco et al. | 473/613 |
| 7,753,811 | B2 | * | 7/2010 | Mark | 473/422 |
| D623,247 | S | | 9/2010 | Zawitz | |
| 7,976,417 | B2 | | 7/2011 | Bagley et al. | |
| D648,406 | S | * | 11/2011 | Hochberg | D21/713 |
| 8,075,431 | B2 | * | 12/2011 | Smith et al. | 473/604 |
| 8,512,170 | B2 | * | 8/2013 | Muscarello | 473/451 |
| 8,579,734 | B2 | * | 11/2013 | Stemle | 473/456 |
| 2007/0010360 | A1 | | 1/2007 | Chang | |
| 2009/0137350 | A1 | | 5/2009 | Lenig | |
| 2011/0190081 | A1 | * | 8/2011 | Boyan | 473/451 |
| 2012/0244962 | A1 | | 9/2012 | Muscarello | |
| 2013/0150188 | A1 | | 6/2013 | Spiegler | |

* cited by examiner 110
151
152
$EP_{2\ SEAM}$
$RA_{2\ SEAM}$
110
116
160
164
165
162
170
172
$EP_{2\ SEAM}$
$RA_{2\ SEAM}$

BALL SKILL ENHANCEMENT TRAINING PROGRAMS AND METHODS

CROSS-REFERENCE TO RELATED APPLICATIONS

This patent application is a continuation-in-part of U.S. patent application Ser. No. 29/397,777, filed on Jul. 20, 2011, and entitled, "Training Ball," and Ser. No. 29/397,778, filed on Jul. 20, 2011, and entitled, "Training Ball," each of which is incorporated in its entirety herein by this reference.

FIELD OF ENDEAVOR

This disclosure relates generally to a baseball and/or softball skill enhancement training program and method.

BACKGROUND

The game of baseball and softball requires advanced skills for outstanding performance. Outstanding performance as a batter requires being a complete hitter. A complete hitter will consistently select to swing at pitches that are accurately perceived to track into his or her hitting zone. Compared to an average batter, a complete hitter will more often make solid contact with swung-at pitches in the hitting zone and partial contact with swung-at pitches trailing out of the hitting zone. A complete hitter is capable of hitting the baseball to a desired area on the field. Becoming a complete hitter requires enhanced and sharpened baseball visual tracking skill training.

Outstanding performance in throwing the baseball (and softball), whether as a pitcher or position player, requires throwing a baseball effectively. Throwing a baseball effectively includes consistently throwing a baseball accurately with appropriate speed. Outstanding pitchers can consistently pitch a baseball to a desired area relative to the strike zone. Outstanding position players can throw a baseball to a desired target on the field. Often, pitchers first learn to throw a baseball effectively by pitching a fastball. Often, position players first learn to throw a baseball in a fastball-like manner. Throwing a baseball effectively typically requires extensive form, accuracy, and speed training.

Many prior training devices are intended to provide skill enhancement for hitting a baseball. Some training devices are specifically directed at enhancing the skill of tracking the baseball. Few of these tracking training devices are adaptations of a conventional baseball only as the training method. For example, U.S. Pat. No. 4,991,838 issued to Groves; U.S. Pat. No. 5,607,152 issued to Strassburger; and U.S. Pat. No. 5,711,725 to Bengtson all apply designs, markings, or a plurality of indicia on the outside surface of a conventional baseball with intent for a batter to better track the baseball.

Many prior training devices known to provide skill enhancement for throwing a baseball are directed toward pitching only. Some of these pitching training devices are adaptations of a conventional baseball only as the training method. Examples include U.S. Pat. No. 2,925,273 issued to Pratt; U.S. Pat. No. 6,663,519 issued to Kuhn; and U.S. Pat. No. 4,991,838 issued to Groves.

While these disclosures may be useful, they do not adequately address the need for enhanced tracking of a thrown baseball as it enters into a batter's hitting zone through the contact point with the bat. These disclosures also do not address the need for immediate feedback to the pitcher, catcher, and instructor for throwing a baseball effectively; specifically with pitchers pitching a two-seam or four-seam fastball and with position players throwing a baseball in a four-seam fastball-like manner.

BRIEF SUMMARY

This disclosure relates to a training program to improve a batter's baseball hitting by enhancing the batter's perception of a pitched baseball. In one embodiment, a training program includes the steps of providing a set of patterned baseballs and at least one conventional baseball. Each of the patterned baseballs includes a cover with a perceptible pattern provided thereon. In one embodiment, the pattern has a generally elliptical marking conforming to a seam disposed on the cover of the baseball and a generally circular marking disposed within the elliptical marking. The pattern can include a coloration selected from a group of different colors, including blue, green, black, and other colors. This coloration is embedded into the baseball cover. One of the baseballs from the set is pitched to a batter, preferably as a two-seam or four-seam fastball, but not required. Thereafter, an instructor or the like detects an audible indication from the batter of the color of the pattern on the pitched baseball as perceived by the batter when the baseball enters the batter's hitting zone through the contact point with the bat. In accordance with the embodiment, a sequence of pitches is thrown to the batter, and the instructor or the like detects the audible indication of the batter of the color of the pattern on the pitched baseball on each of the pitches thrown in the sequence. After several meaningful sessions with this program, the enhanced tracking skill developed by the batter can translate to better overall hitting performance in game situations.

Embodiments of the present disclosure are directed to enhancing a batter's overall ability to track a pitched baseball and sharpening the narrow tracking skill as the ball enters the batter's hitting zone through the contact point with the bat. This enhanced tracking skill can be accompanied by the batter consistently moving his or her head and eyes with the baseball's flight through the contact point with the bat. This can be conducted by imbedding a distinct single-colored pattern into the baseball cover material, from a limited selection of colors, so that in a standard batting practice exercise the batter will identify the colored pattern on the pitched baseball but not be able to detect it until it has entered the batter's hitting zone. With respect to the present disclosure, to assure the embodiment is not detected by the batter until the pitched embodiment is in the batter's hitting zone, it is preferred that a fastball is pitched as some curve-ball like pitches may reveal the color on the ball to the batter too early in the pitch. After several meaningful batting practice sessions with these baseballs, the can develop the consistent tracking skill of moving his or her head and eyes with the flight of the baseball all the way to the contact point with the bat. The batter's newly-developed natural and consistent tracking skills can enhance a batter's hitting performance in game situations. Also, after several meaningful batting practice sessions with a reasonable set of these baseballs and reasonable number of batters, the integrity of the colored pattern on these baseballs will still be maintained since it is imbedded into the baseball cover.

The disclosure also relates to additional training methods to provide immediate feedback that is clear and dependable to the pitcher, position player, catcher, or instructor for accuracy in pitching or throwing a fastball as a two-seam or four-seam fastball. To help assure a two-seam fastball is accurately pitched, in another aspect of the disclosure, a dark color can be located on distinct lateral positions on the cover of a conventional baseball. This embodiment can enable a pitcher, catcher, or instructor to immediately observe whether a two-seam fastball is pitched accurately. To help assure a four-seam fastball is accurately pitched, in yet another aspect of the disclosure, a contrasting dark color marking may be located on a distinct half of the cover of a conventional baseball wherein the other half of the baseball is a light color marking. This embodiment enables a pitcher, position player, catcher, or instructor to immediately observe whether a four-seam fastball is thrown accurately. These colorations are embedded into the baseball cover. These fastball embodiments are uniquely designed to provide immediate feedback that is clear and dependable to a pitcher, position player, catcher, or instructor for accuracy in pitching or throwing a fastball as a two-seam or four-seam fastball, respectively.

Training programs that include balls constructed according to principles of the present disclosure can enhance the physical throwing mechanics of a pitcher or position player to accurately throw a two-seam fastball or a four-seam fastball. The newly-developed consistent throwing skills can enhance a pitcher's or position player's throwing performance in game situations.

DETAILED DESCRIPTION

Figure 1:
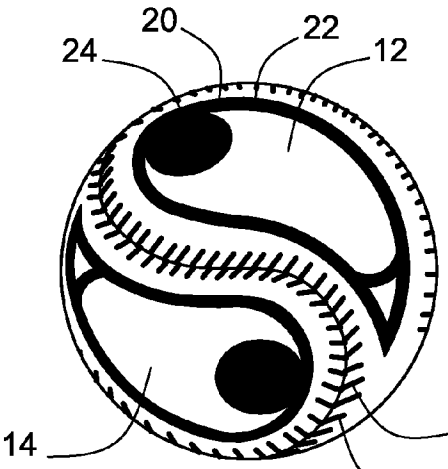
FIG. 1 is a perspective view of an embodiment of a patterned baseball constructed according to principles of the present disclosure.
Figure 2:
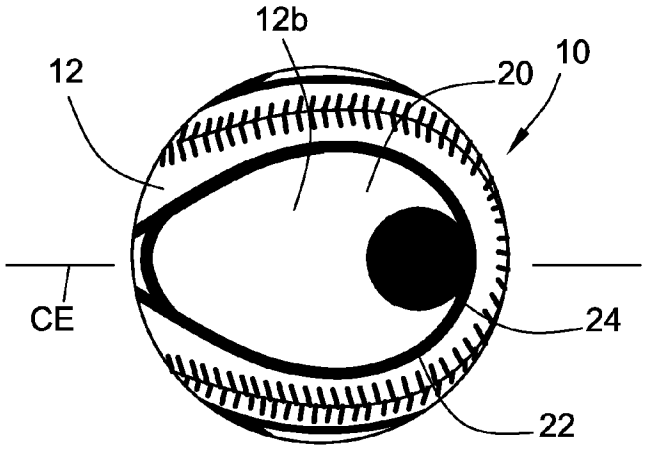
FIG. 2 is a front view of the patterned baseball shown in FIG. 1.
Figure 3:
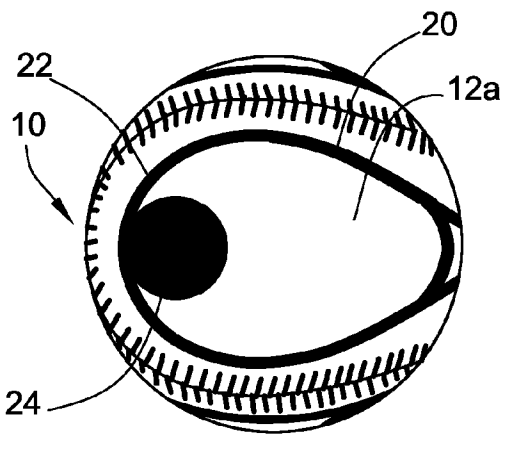
FIG. 3 is a rear view of the patterned baseball shown in FIG. 1.
Figure 4:
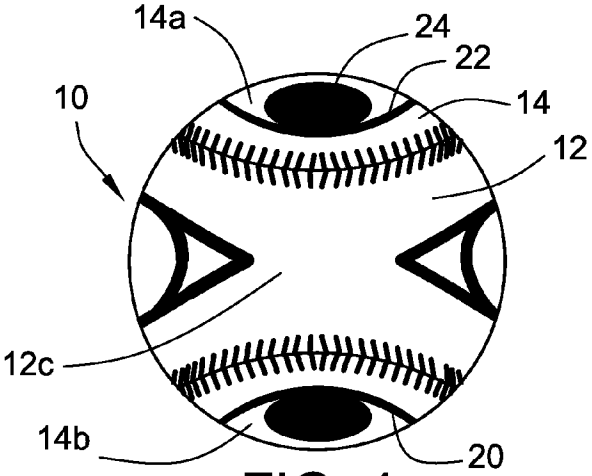
FIG. 4 is a right-side view of the patterned baseball shown in FIG. 1.
Figure 5:
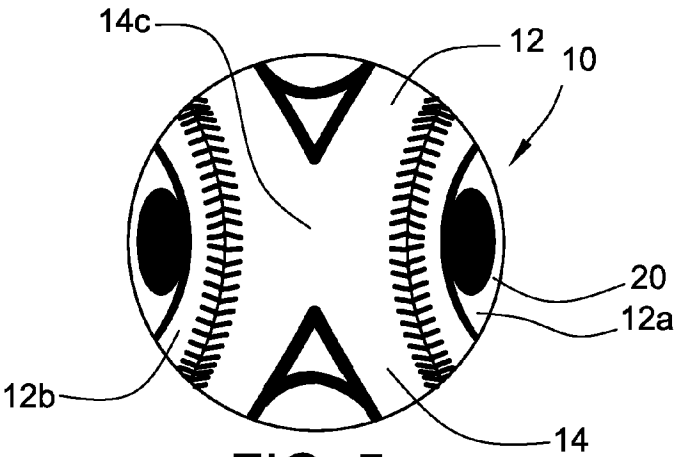
FIG. 5 is a left-side view of the patterned baseball shown in FIG. 1.

Generally, this disclosure relates to a baseball tracking enhancement program utilizing a baseball and/or softball configuration that has distinct single-colored patterns placed thereon. In one embodiment, the pattern is of a color selected from a group of color options. A plurality of baseballs of different colors, and optionally an unmarked baseball, are randomly selected by a pitcher and thrown to a batter. By randomly choosing one of the balls having a pattern with one of the selected colors or the unmarked baseball, a training program for use in baseball and softball batting practice may be readily achieved. In another aspect, the disclosure is directed to embodiments of a baseball each having distinct pattern configurations that are suitable for use in methods for pitching and throwing training.

Embodiments of a training program according to principles of the present disclosure can enhance a batter's overall tracking skill of a pitched baseball and sharpens the narrow tracking skill as it enters a batter's hitting zone through the contact point with the bat. As referred to herein, a batter's hitting zone is an area around the batter in which the batter preferably hits the pitched baseball. In one embodiment, the batter's hitting zone is defined in relation to a standard baseball field layout with a home plate area including standard right-side and left-side batter's boxes. With the batter standing in either batter's box, the hitting zone, in this embodiment, is an area that is substantially a square with each side about seven feet long, and in other embodiments an area that is substantially a square with each side approximately four times the width of a standard-dimensioned home plate (seventeen inches). Preferably the batter's hitting zone is in overlying relationship with at least a portion of home plate. In another embodiment, the hitting zone is defined by a pair of parallel lines that are disposed at about 45 degrees to the foul lines with one line substantially aligned with the rear edge of the batter's boxes of a baseball field having a standard layout, and the other line in spaced relationship with the first line a distance about one-eighth of the distance between the rear tip of home plate and the pitching rubber on the pitcher's mound of a standard baseball field.

The contact point is the point within the hitting zone at which the bat contacts the pitched baseball. Because the time between the baseball being released by the pitcher, entering the hitting zone, and being contacted by the bat is very short, a batter reflexively reacts to make solid contact. In accordance with an embodiment of the disclosure, a distinct single-colored pattern is imbedded into a baseball cover so that in a standard batting practice exercise the batter will not be able to detect the colored pattern on the pitched baseball until it has entered the batter's hitting zone. The integrity of the colored pattern on the baseball can be maintained by being imbedded into the baseball cover.

In general, a batter's approach to hitting a baseball may be viewed in three phases. A first phase can comprise a time interval prior to the baseball being pitched. During the first phase, the batter can attend to a broad set of information to assess the overall game situation. Information may include knowledge of his or her preferred hitting area within the hitting zone, coaching instructions, qualities of the pitcher and defense, field and weather conditions, score, inning, outs, ball-strike count, the number and location of runners on base, etc.

A second phase can comprise a time interval beginning with the pitcher's throwing motion to soon after the baseball is pitched. During the second phase, the batter can attend to the baseball with a narrow visual focus to begin tracking the flight of the baseball to select whether or not to swing the bat at the baseball. It is during this time interval that the batter preferably strives to accurately perceive whether the baseball will track into his or her preferred hitting area within the hitting zone. This phase ends when the batter selects to swing or not swing at the baseball.

The third phase can comprise a time interval from when the batter selected to swing at the baseball through the contact point with the baseball. During this phase, the batter preferably attends to the baseball with a more sharpened narrow visual focus to further track the baseball. This sharpened narrow tracking of the baseball helps the batter make any necessary physical adjustments to assure the bat will make contact with the baseball. If the baseball indeed tracks into the batter's preferred hitting area and the batter effectively tracks the baseball, the batter has a strong likelihood to make solid contact with the baseball. If the baseball trails outside the batter's preferred hitting area and the batter effectively tracks the baseball, the batter still has a chance to make solid contact with the baseball and a decent chance to make partial contact with the baseball. Therefore, if a batter consistently tracks a baseball's flight to identify the appearance of a colored pattern on the baseball, the batter can improve his or her hitting skills.

When the batter is swinging the bat in an attempt to hit the baseball, the batter typically makes major physical movements with the legs, torso, and arms. Along with these major physical movements, it is important the batter's head swivels and eyes move relative to the baseball flight to help the batter track the baseball into the hitting zone through the contact point with the bat. These head and eye movements for tracking the baseball aid the batter in making proper minor physical adjustments to the major physical movements to improve the likelihood of making solid contact with the baseball.

When the batter poorly contacts the baseball or misses the baseball entirely, one of the predominant reasons is due to the batter not tracking the baseball at some point while he or she is swinging the bat. This may be largely due to the batter's head not swiveling and eyes not moving with the baseball's flight as it enters the hitting zone. Such lack of head and eye movement can inhibit the batter's ability to properly track the baseball for its flight location. A proficient hitter, when selecting to swing the bat at the pitched baseball, consistently swivels the head and moves the eyes to track the baseball into the hitting zone through the contact point with the bat.

FIGS. 1-5, illustrate a preferred embodiment of a baseball 10 constructed in accordance with principles of the present disclosure. In the illustrated embodiment, the baseball 10 comprises first and second white panels 12, 14 that are stitched together at a continuous seam 16 with stitching 17, which may conventionally be waxed red cotton thread or the like. The panels 12, 14 can be made from any suitable material, including a natural material, such as leather, for example, or a suitable synthetic material. The illustrated baseball 10 is sized to conform to the size of a conventional baseball which is 9 to 9¼-inches in circumference. In other embodiments, a ball constructed in accordance with principles of the present disclosure can have different sizes, such as those typically associated with softball, for example.

Figure 6:
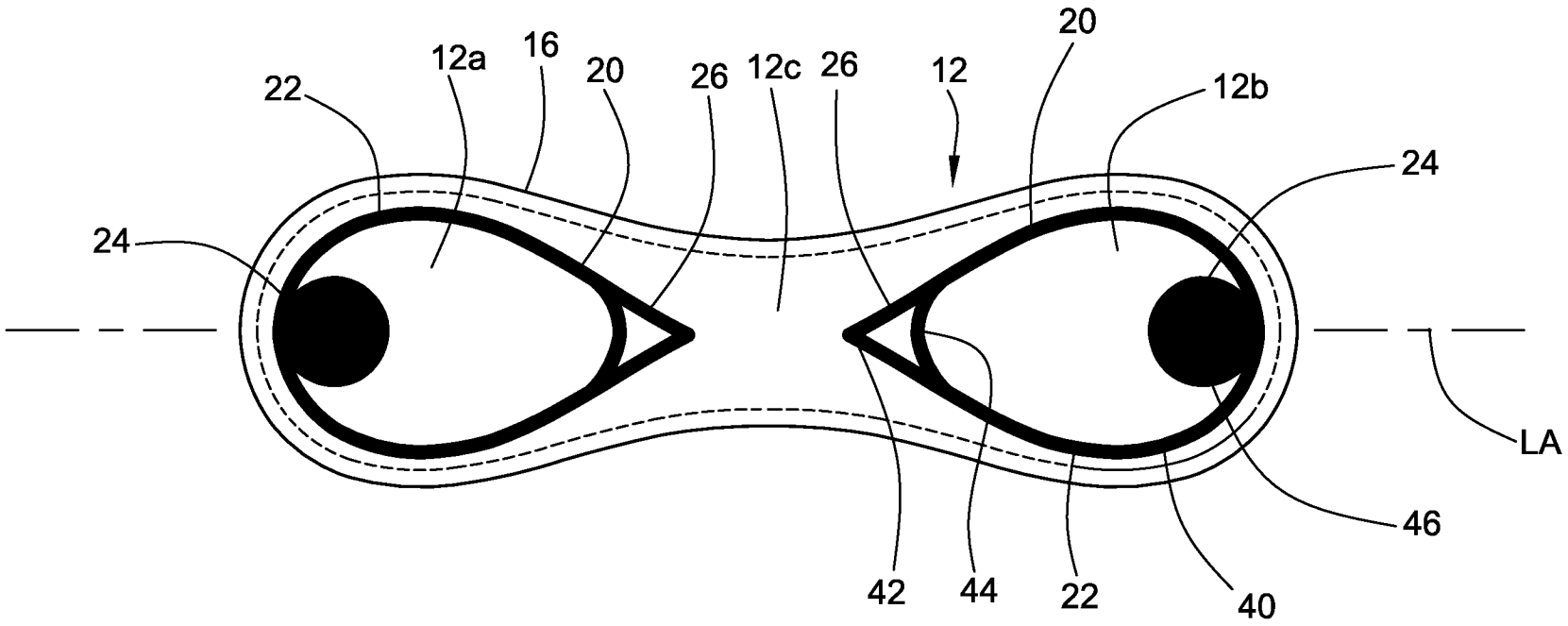
FIG. 6 is a top view of one of the panels used to construct the cover of the patterned baseball shown in FIG. 1.

As will be understood by those skilled in the art, the panels 12, 14 are formed in surrounding relation with respect to a round cushioned cork center (commonly referred to as a "pill"), which itself can be surrounded by wool and/or polyester/cotton yarn wound around the pill (not shown) in a known manner. In the illustrated embodiment, the panels 12, 14 are substantially identical to each other. Accordingly, it will be understood that the description of one panel is applicable to the other panel, as well. Referring to FIG. 6, the panel 12 includes two distal sections 12*a*, 12*b* connected together by a central necked portion 12*c*. The sections 12*a*, 12*b* may be viewed as quadrants of the baseball 10 when the panels 12, 14 are joined together.

In accordance with one aspect of the disclosure, the baseball 10 includes a preselected design comprising a pattern 20 formed thereon. In the illustrated embodiment, the pattern is repeated in each distal section 12*a*, 12*b*, 14*a*, 14*b* of the panels 12, 14, respectively. In this example, the pattern 20 includes a line, or line-like feature 22, and a dot 24, or dot-like feature including a ring or ring-like feature. As best seen in FIG. 6, the closed line feature 22 is preferably about 1/16-inch to about 5/16-inch in width, is predominantly adjacent to the panel edges and no less than about ⅛-inch and no more than about ⅜-inch from holes for the red lacing in the majority of the quadrant area. This line 22 can converge to form a closed oval-, tear-, egg-, or eye-shaped feature 26 toward the neck 12*c* of the panel. The dots 24 and the eye-shaped feature 26 of the patterns 20 on the panel 12 are substantially aligned along a central longitudinal axis LA of the panel. When the panel is mounted as part of the baseball, the longitudinal axis LA comprises a central equatorial plane CE of the baseball 10 (see FIG. 2). In other embodiments, the feature 26 and/or the dot 24 can be offset from the central longitudinal axis LA.

Along with distance and linear speed, the proximity of the line feature 22 to the stitching 17 allows the red lacing on the rapidly spinning baseball 10 to hide the color of the line 22 from the batter. To help the batter detect the color of the pattern 20 on the baseball 10 when the baseball 10 is in the hitting zone, the dot, dot-like, ring, or ring-like feature 24, which can have a ⅛- to ½-inch radius, is disposed in abutting relationship with a portion of the line 22 toward the distal part of the panel.

In one preferred embodiment, the dot 24 is positioned as far away from the center of the quadrant as possible. A dot centered or near-centered in the panel quadrant can have its color detected by the batter well before the baseball enters the batter's hitting zone. With a centered dot position, a two-seam fastball will have its rotating axis inside the dot allowing for the rotating dot to be visible by the batter early in the pitch. Also with a centered dot position, a four-seam fastball will have the spinning dots produce a single line phenomenon allowing for the color of this line to be visible by the batter early in the pitch. This early pitch color detection of the baseball by the batter prevents the proper head and eye movements necessary to develop enhanced and natural tracking skills.

As can be seen in FIG. 6, the illustrated pattern 20 can be described in reference to physiological terms associated with a human eyeball. For example, each baseball quadrant 12*a*, 12*b* has a closed ⅛-inch in width line 40 (Sclera Line) tracing along the seam edge 16 at approximately ¼-inch from the holes for the red lace stitching 17. The Sclera Line 40 forms the outline of an eyeball. The Sclera Line 40 connects together at a Macula Point 42 as each quadrant narrows toward the central neck 12*c* of the panel 12.

An additional slightly curved line (Retina Line) 44, with the same width as the Sclera Line 40, is placed near the Macula Point 42. The Retina Line 44 connects to the Sclera Line 40 at two points approximately ½- to 1-inch from the Macula Point 42.

A solid, circular ring (Iris) 46 is placed toward the broad part of the Sclera Line 40, opposite the Macula Point 42. The Iris 46 is about ¾-inch in diameter and abuts the Sclera Line 40. The shape of the Sclera Line 40, with the Retina Line 44 and the Iris 46, create the appearance of an eyeball from a cross-sectional perspective.

In a preferred embodiment, a set of baseballs 10 is provided in which each baseball has a pattern 20 formed thereon wherein at least two baseballs 10 have different-colored patterns 20. Optionally, the set of baseballs includes at least one conventional baseball which does not include any pattern thereon.

Using a baseball constructed according to principles of the present disclosure thus enhances a batter's tracking skills of a baseball through pitching as a two-seam fastball or a four-seam fastball a meaningful series of baseballs from a set that includes a specifically-designed pattern on the outer cover on each baseball, where each baseball's pattern is colored a distinct shade of blue, black, or green, but can include other colors in other embodiments, and imbedded into the baseball cover. The set can also include baseballs with no colored pattern on the outer cover. Per each fastball pitched baseball from this set, the batter can be instructed to detect which color, if any, is on the baseball and verbally respond after the ball has been contacted or passed the potential contact point with the bat. The batter should say "Check", or the like, if unable to detect what color, if any, is on the pitched baseball. These verbal responses insure the batter is developing a natural head and eye movement for following the flight of the baseball to the contact point. This enhanced tracking skill can be translated into game situations.

A baseball constructed according to principles of the present disclosure thus provides an ideal design to produce the desired result, namely, that the batter cannot detect the color on the ball when pitched as a fastball until it has entered the hitting zone. This discovered design has color strategically positioned and imbedded into the baseball cover so that when said ball is pitched relatively accurately, the color is obscured and undetectable by the batter from the time it leaves the pitcher's hand to the time it begins to enter the batter's hitting zone. This early color detection obscurity is due to the baseball's distance, linear speed, spinning speed, and red lacing as a non-color option hindrance. Since the color is imbedded into the baseball cover, the duration of these baseballs are significantly lengthened as the color is not destroyed by the multiplicity of hits imparted onto these baseballs.

As the batter tracks the pitched baseball entering their hitting zone, the batter's head and eyes must move in coordinated manner in relation to the baseball flight to determine the correct color on the baseball. The batter's repetitive meaningful experience in moving their head and eyes to better track the baseball entering their hitting zone through the contact point with the bat will create muscle memory leading to natural mechanical movement. The resulting developed head and eye natural physical movements can provide corresponding improvements to the batter's overall swing mechanics. These enhanced tracking skills leading to improved natural movements which can allow the batter to become a proficient hitter in a game setting.

Figures 10, 11:
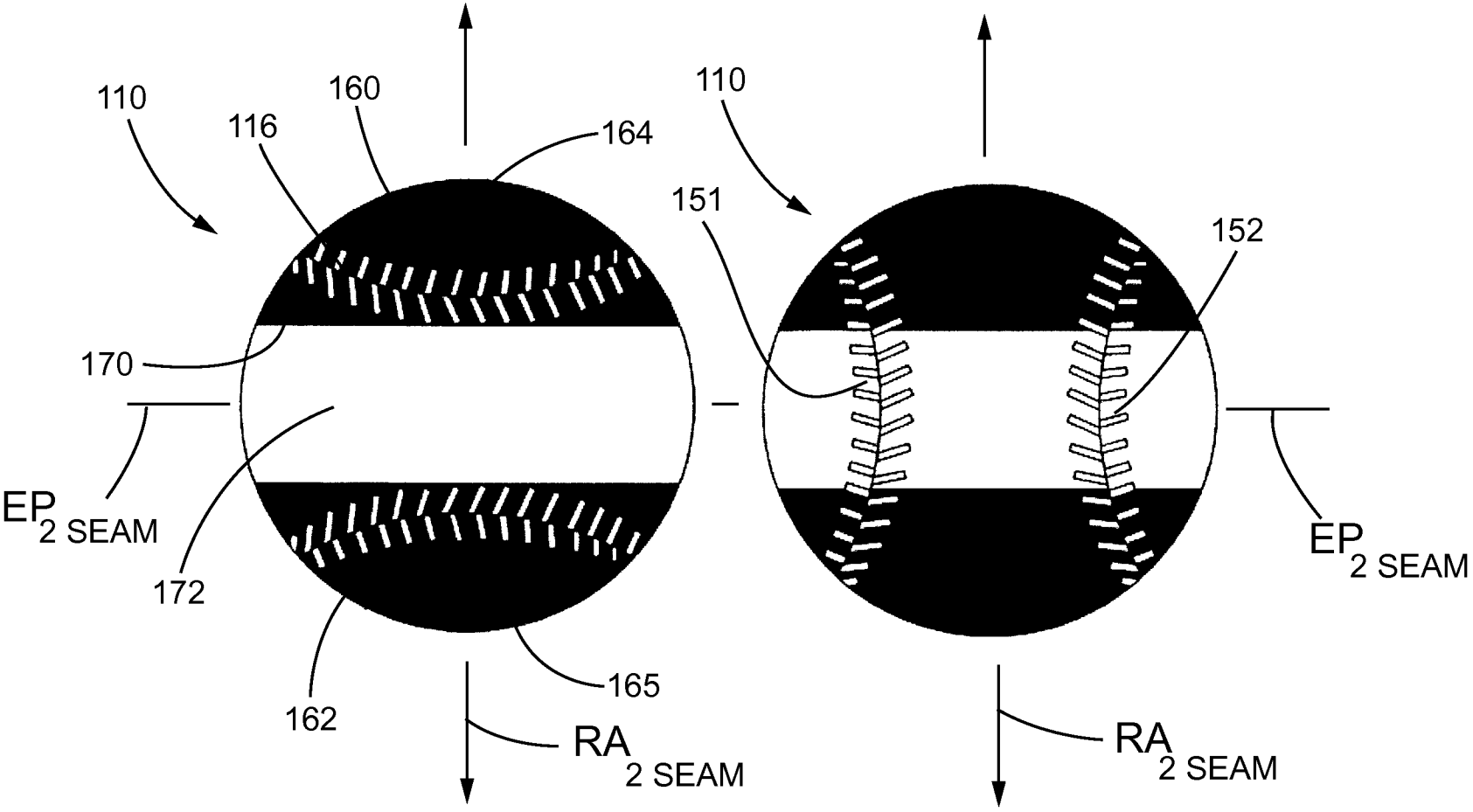
FIG. 10 is a right side view of the patterned baseball shown in FIG. 7.
FIG. 11 is a left side elevational view of the patterned baseball shown in FIG. 7.

FIGS. 7-11 illustrate an embodiment of a patterned baseball 110 according to another aspect of the disclosure. In this embodiment, the baseball 110 may be used as a training aid to provide immediate feedback in the accuracy of pitching a fastball as a two-seam fastball. Referring to FIGS. 10 and 11, a two-seam fastball is accurately pitched when the baseball 110 is rotating around an axis $RA_{2\ seam}$ so that the seam 116 crosses a two-seam equatorial plane $EP_{2\ seam}$ (substantially perpendicular to the axis $RA_{2\ seam}$) at two locations 151, 152 per 360 degree revolution. Distinct lateral positioning of a dark color on the baseball cover, appearing as a pair of caps 160, 162 having a contrasting color to a central region, has been discovered to assist the pitcher, catcher, and instructor in observing whether a two-seam fastball is pitched accurately or not. With respect to the illustrated baseball 110, the positioning of the dark caps 160, 162 includes the horizontal polar ends 164, 165 of the baseball 110 to a point about ⅜-inch from the center of the baseball. This leaves approximately ¾- to 1-inch width of unaltered white cover that forms a white stripe 170 encircling an equatorial two-seam center band 172 of the baseball 110.

Figure 8:
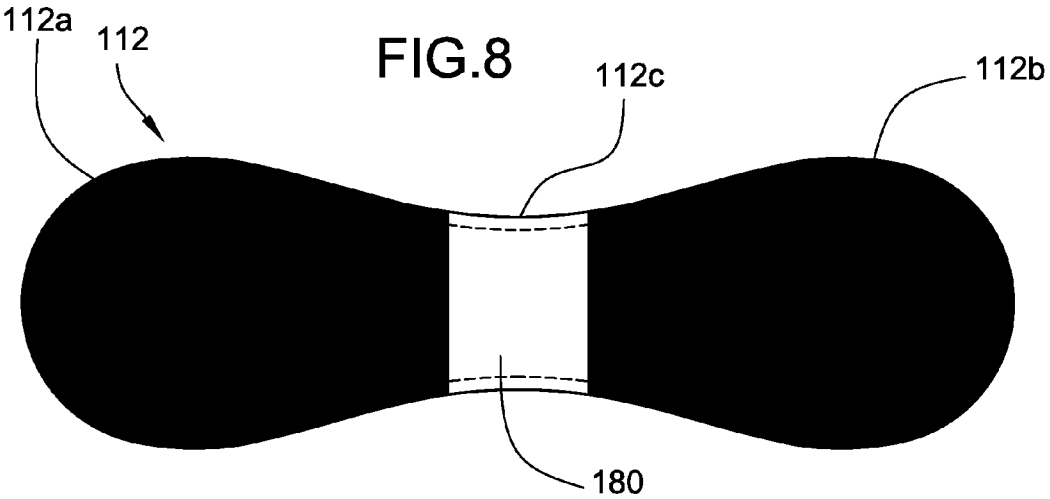
FIGS. 8 and 9 are top views of first and second panels used to construct a cover of the baseball of FIG. 7.
Figure 7:
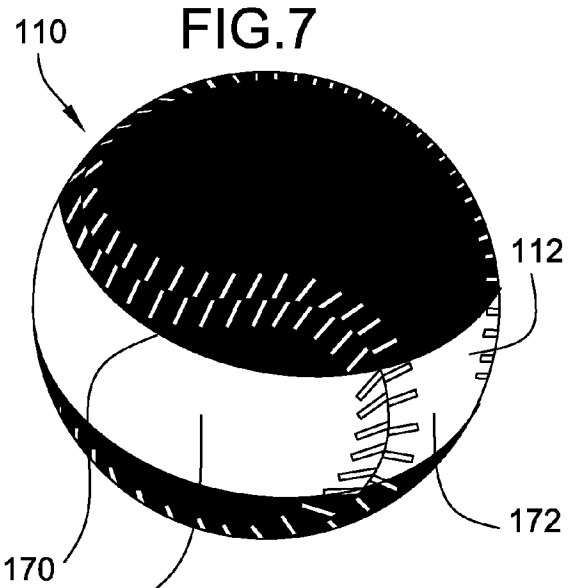
FIG. 7 is a perspective view of another embodiment of a patterned baseball constructed according to principles of the present disclosure that can be used as a training aid to pitch or throw a two-seam fastball.

Referring to FIG. 8, a first panel 112 of the baseball 110 is shown. In the first panel 112, both distal ends 112*a*, 112*b* include a dark, contrasting color. A central necked portion 112*c* of the first panel 112 includes a white stripe portion 180.

Figure 9:
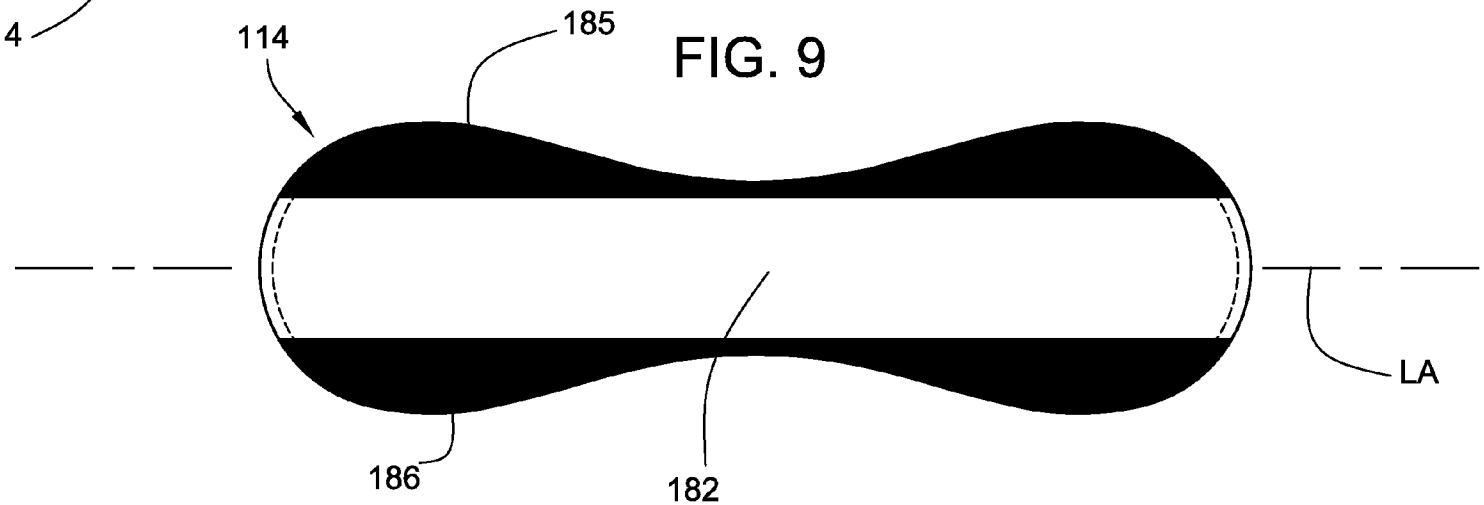

Referring to FIG. 9, a second panel 114 of the baseball 110 is shown. The second panel 114 includes a white strip portion 182 that extends in parallel relationship to a central longitudinal axis LA of the second panel 114. The peripheral edges 185, 186 of the second panel 114 include a dark, contrasting color. When assembled, the white stripe portion 180 of the first panel 112 and the white stripe portion 182 of the second panel 114 cooperate together to form the white stripe 170 encircling the equatorial two-seam center band 172.

If the baseball 110 is accurately pitched as two-seam fastball, the 1-inch wide white stripe 170 encircling the equatorial two-seam center band 172 will illuminate discernibly as a crisp bright white rotating ring as observed by the pitcher, catcher, or instructor as it travels in the air. This resultant, success-informing, rotating bright white ring can be pointedly observed in various background environments. The dark contrasting-colored caps 160, 162 can form a background for the bright white color of the white stripe 170 encircling the equatorial two-seam center band 172. This rotating bright white ring can be visible in normal, baseball playing lighting environments and can be of any vertical, horizontal, or diagonal orientation. The integrity of the colored pattern on the baseball can be maintained by being imbedded into the baseball cover. Since the color is imbedded into the baseball cover, the useful life of these baseballs can be significantly lengthened as the colored pattern can remain visible after a number of training sessions with these baseballs where the baseballs are struck with a bat a number of times.

Figures 15, 16:
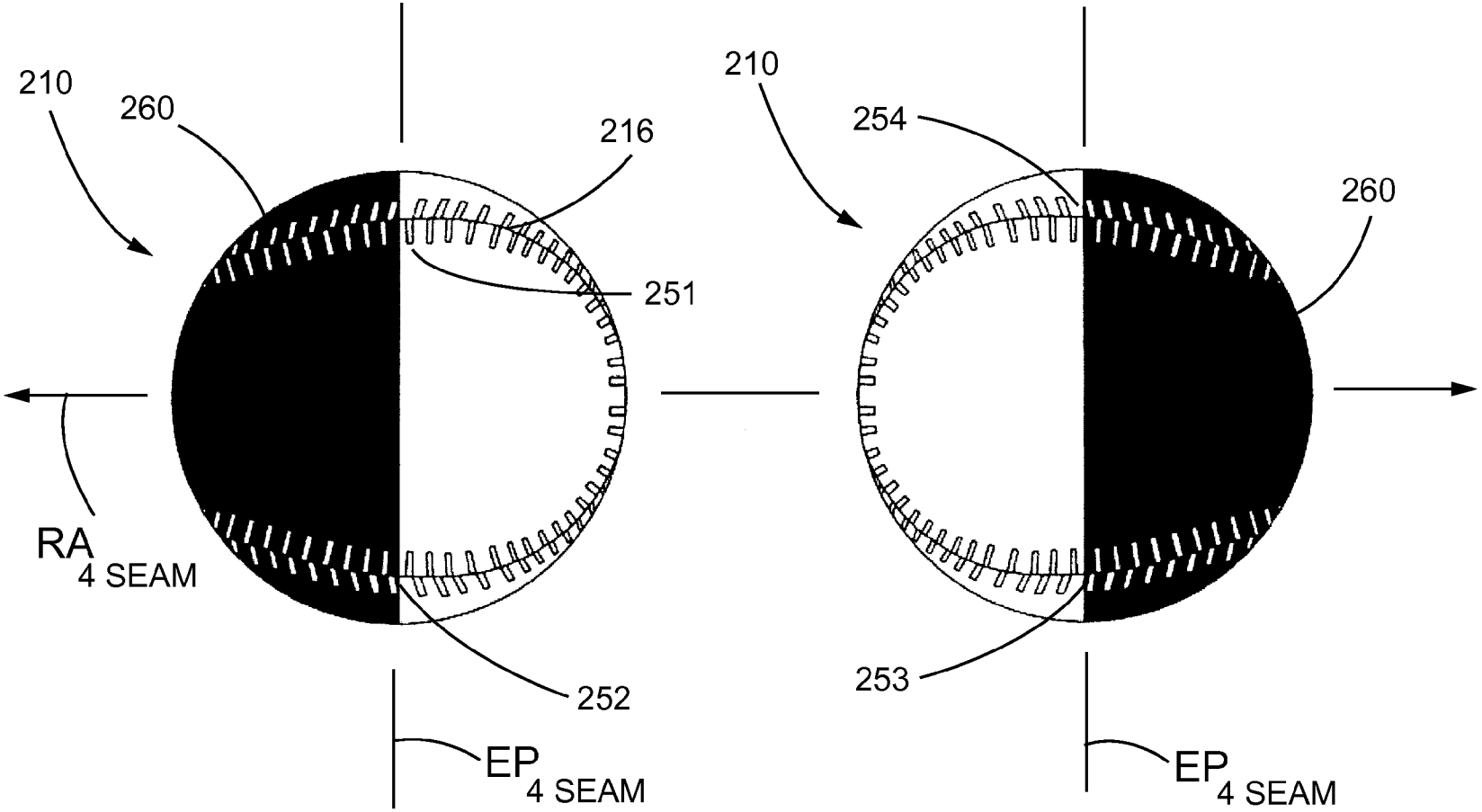
FIG. 15 is a front elevational view of the patterned baseball shown in FIG. 12.
FIG. 16 is a rear elevational view of the patterned baseball shown in FIG. 12.

FIGS. 12-16 illustrate an embodiment of a patterned baseball 210 according to yet another aspect of the disclosure. In this embodiment, the baseball 210 may be used as a training aid to provide immediate feedback in the accuracy of pitching a four-seam fastball. Referring to FIGS. 15 and 16, a four-seam fastball is accurately pitched when the baseball 210 is rotating around an axis $RA_{4\ seam}$ so that the seam 216 crosses a four-seam equatorial plane $EP_{4\ seam}$ (substantially perpendicular to the axis $RA_{4\ seam}$) at four locations 251, 252, 253, 254 per 360 degree revolution. Placement of a contrasting, dark color on a distinct half or hemisphere 260 of the baseball cover, appearing as a single dark bowl, has been discovered to assist the pitcher, position player, catcher, or instructor in observing whether a four-seam fastball is pitched accurately or not. With respect to the baseball 210 embodiment, the contrasting, dark color positioning is disposed on the dark, contrasting hemisphere 260, and the remainder of the baseball 210 comprises a white hemisphere 262 configured to contrast with the dark hemisphere 260.

Figure 13:
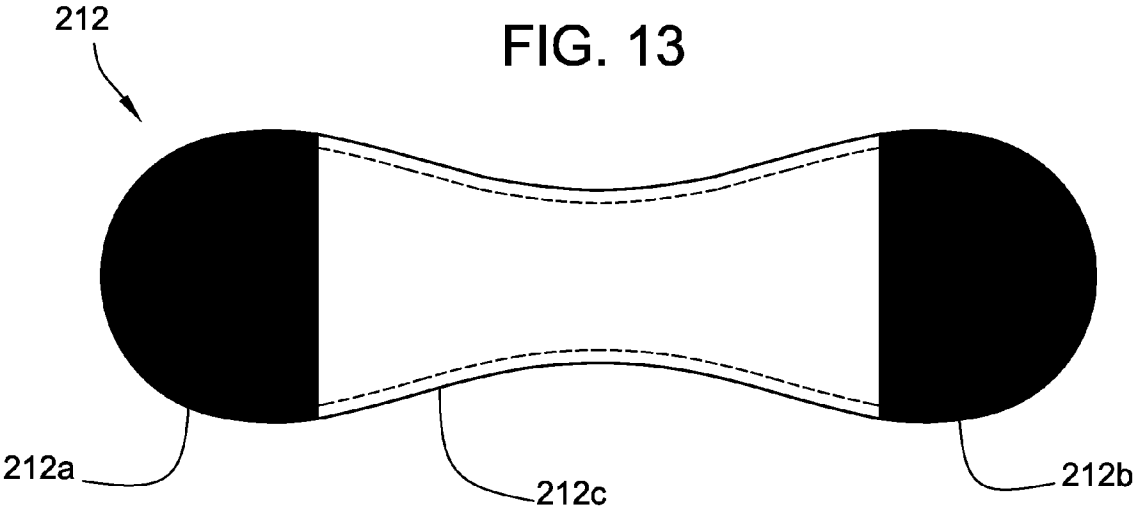
FIGS. 13 and 14 are top views of first and second panels used to construct a cover of the baseball of FIG. 12.
Figure 12:
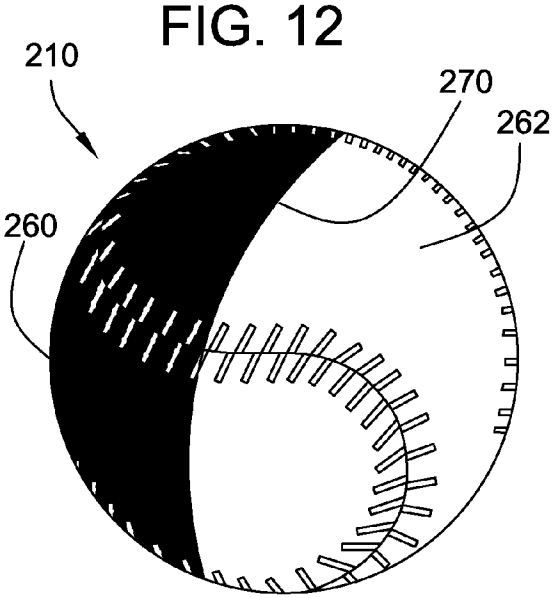
FIG. 12 is a perspective view of yet another embodiment of a patterned baseball constructed according to principles of the present disclosure that can be used as a training aid to pitch or throw a four-seam fastball.

Referring to FIG. 13, a first panel 212 of the baseball 210 of FIG. 12 is shown. The first panel 212 includes distal portions 212*a*, 212*b* which are dark and used to form part of the dark hemisphere 260. A central necked portion 212*c* of the first panel is used to form part of the white hemisphere 262.

Figure 14:
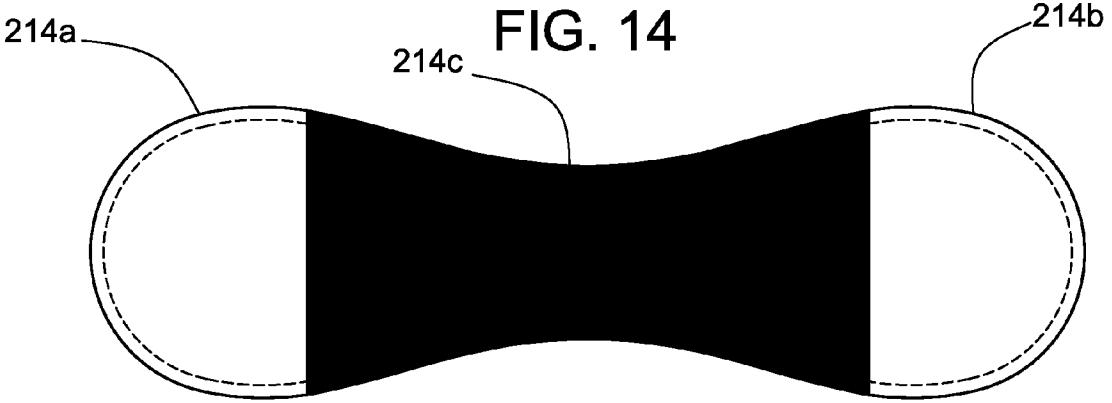

Referring to FIG. 14, a second panel 214 of the baseball 210 of FIG. 12 is shown A central necked portion 214*c* of the second panel 214 is used to complete the dark hemisphere 260. Distal portions 214*a*, 214*b* of the second panel finish the white hemisphere 262. In this way, the dark color covers the dark hemisphere 260. The dark hemisphere 260 and the white hemisphere 260 meet at a four-seam panel equator line 270 of the baseball 210. Together, the cover of the baseball 210 is equally divided with dark color and a contrasting lighter color at a location in which the four-seam equator line 270 intersects the seam 216 at four locations 251, 252, 253, 254.

If the baseball 210 is correctly pitched, the rotating borderline 270 separating the dark half bowl 260 from the unaltered remaining white half bowl 262 will be clearly defined and illuminate discernibly as observed by the pitcher, position player, catcher, or instructor as it travels in the air. The resultant, success-informing, rotating borderline 270 is also pointedly observed in various background environments. This is due to the dark-colored half bowl 260 contrasting against background colors as well as forming a background for the bright, contrasting white color of the other hemispheres 262 of the ball 210. This rotating borderline 270 can appear in normal baseball playing lighting environments. The integrity of the colored pattern on the baseball can be maintained by being imbedded into the baseball cover. Since the color is imbedded into the baseball cover, the useful life of these baseballs can be significantly lengthened as the colored pattern can remain visible after a number of training sessions with these baseballs where the baseballs are struck with a bat a number of times.

Various advantages flow from the disclosure herein. The disclosure establishes a definitive design style leading to a training program that effectively challenges a batter to enhance his or her overall tracking skill of a pitched baseball and sharpens the narrow tracking skill as it enters the hitting zone through the contact point with the bat. In this regard, the present disclosure provides a design and a pattern with appropriate color options that are imbedded into a baseball cover so the batter cannot detect the color of the pattern before the baseball has entered the hitting zone. A pattern can have single color options imbedded in a covered baseball so when a series of these baseballs are pitched, preferably by not required as a fastball, the color is detectable only in the hitting zone by the batter. The imbedded color of the pattern applied to the baseball cover also aids in durability of these specialized baseballs even after several hundred hits have been applied to them. Accordingly, the disclosure develops a batter's head and eye movement to consistently and naturally track the baseball from the pitcher's hand all the way to the contact point with the bat. This leads to a batter developing enhanced pitch selectivity, enhanced minor physical adjustments necessary to apply when swinging the bat at the ball, and enhanced likelihood of making solid contact with a pitched baseball in the hitting zone and partial contact with pitches trailing out of the hitting zone. The present disclosure further realizes an associated training device leading to a training method that provides immediate feedback that is clear and dependable to a pitcher, position player, catcher and/or instructor for accurately pitching a two-seam fastball and a four-seam fastball.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A method of using a training program for improving hitting of a baseball by enhancing a batter's tracking skill to follow a pitched baseball, the method comprising:

(a) selecting a baseball from a set of baseballs, each baseball of the set of baseballs including a cover having a pair of panels joined together by a continuous seam of lacing, the cover having a single-colored pattern provided thereon, the single-colored pattern including a closed linear marking and a generally circular marking, the closed linear marking having a curved portion with a shape generally conforming to a portion of the seam and disposed in offset, adjacent relationship to the portion of the seam, and the generally circular marking disposed within the curved portion of the closed linear marking, wherein the single-colored pattern of the selected baseball of the set of baseballs is a first color, and the set of baseballs includes at least one other baseball having a single-colored pattern of a second color, and the first color is different from the second color;

(b) pitching the selected baseball to a batter;

(c) detecting, when the selected baseball is pitched to the batter, an audible indication from the batter of the color of the single-colored pattern on the selected baseball as perceived by the batter when the selected baseball has entered a hitting zone adjacent to the batter.

2. The method according to claim 1, wherein the generally circular marking of the single-colored pattern of each baseball of the set of baseballs intersects at least a portion of the respective closed linear marking.

3. The method according to claim 1, wherein at least one of the baseballs of the set of baseballs has a cover in which the perceptible pattern is imbedded therein.

4. The method according to claim 1, wherein the pitched baseball is pitched as a two-seam fastball.

5. The method according to claim 1, wherein the pitched baseball is pitched as a four-seam fastball.

6. The method according to claim 1, wherein the set of baseballs includes at least one baseball which does not have a colored pattern provided thereon.

7. The method according to claim 1, further comprising:

(d) pitching a second selected baseball from the set of baseballs to a batter;

(e) detecting, when the second selected baseball is pitched to the batter, an audible indication from the batter of the color of the single-colored pattern on the second selected baseball as perceived by the batter when the pitched second selected baseball has entered the hitting zone adjacent the batter.

8. The method according to claim 1, wherein the closed linear marking of the single-colored pattern of each patterned baseball of the set of baseballs circumscribes the respective generally circular marking.

9. The method according to claim 8, wherein the seam of the first baseball and the second baseball has a seam color, and the first color and the second color are both different from the seam color.

10. The method according to claim 9, wherein the seam color is red, and the first color and the second color are selected from the group consisting of: blue, black, and green.

11. The method according to claim 8, wherein the set of baseballs includes a third baseball with a single-colored pattern of a third color, wherein the third color is different from the first color and the second color.

12. The method according to claim 11, wherein the seam of the first baseball, the second baseball, and the third baseball has a seam color, and the first color, the second color, and the third color are each different from the seam color.

13. The method according to claim 8, wherein the single-colored pattern of each of each patterned baseball of the set of baseballs is constructed and positioned relative to the respective seam such that the color of the single-colored pattern of the pitched baseball is less detectable by the batter when the pitched baseball is outside of the hitting zone than when the pitched baseball is within the hitting zone of the batter.

14. The method according to claim 1, further comprising:

(f) providing a two-seam training baseball having a cover with a pair of panels joined together by a continuous seam of lacing, the baseball defining a two-seam equatorial plane, the continuous seam configured such that the seam intersects the two-seam equatorial plane twice, the cover having a two-seam training pattern provided thereon, the two-seam training pattern including a two-seam equatorial center band disposed between a pair of laterally-flanking caps, the two-seam equatorial center bend extending along the two-seam equatorial plane, the two-seam equatorial center band and the caps having contrasting colors such that each cap color is different than the center band color, the pattern adapted to provide a color-contrasting, continuous ring that is aligned with a path of rotation of the baseball about a two-seam rotational axis, which is perpendicular to the two-seam equatorial plane;

(g) pitching the two-seam training baseball to a target;

(h) detecting, when the two-seam training baseball is pitched to the target, a visible indication, based upon an appearance of the pattern on the pitched baseball, whether the baseball was pitched such that it is rotating about the two-seam rotational axis.

15. The method according to claim 1, further comprising:

(i) providing a four-seam training baseball having a cover with a pair of panels joined together by a continuous seam of lacing, the baseball defining a four-seam equatorial plane, the continuous seam configured such that the seam intersects the four-seam equatorial plane in four separate places, the cover having a four-seam training pattern provided thereon, the four-seam training pattern including a pair of color contrasting portions respectively disposed on opposing sides of the four-seam equatorial plane, the pattern adapted to provide a visual indication to what degree the four-seam training baseball is rotating about a four-seam rotational axis, which is perpendicular to the four-seam equatorial plane;

(j) pitching the four-seam training baseball to a target;

(k) detecting, when the four-seam training baseball is pitched to the target, the visible indication.

16. The method according to claim 15, wherein the contrasting portions comprise contrasting hemispheres.

* * * * *